US005588892A

United States Patent [19]

McMahon

[11] Patent Number: 5,588,892

[45] Date of Patent: Dec. 31, 1996

[54] COMBINATION FLOTATION DEVICE AND SWIMMING AID

[75] Inventor: Donna McMahon, Stuart, Fla.

[73] Assignee: Donna McMahon, Inc., Stuart, Fla.

[21] Appl. No.: 538,862

[22] Filed: Oct. 4, 1995

[51] Int. Cl.[6] ..... B63C 9/115

[52] U.S. Cl. ..... 441/116; 441/118

[58] Field of Search ..... 441/88, 102, 104, 441/110, 112, 114–120; D21/238

[56] References Cited

U.S. PATENT DOCUMENTS

| | | | |
|---|---|---|---|
| D. 56,815 | 12/1920 | Kelso | D21/238 |
| D. 245,881 | 9/1977 | Siddons | D2/40 |
| D. 245,882 | 9/1977 | Siddons | D2/40 |
| D. 293,356 | 12/1987 | Holden | D21/238 |
| D. 293,618 | 1/1988 | Berenson | D2/190 |
| D. 330,740 | 11/1992 | Layton | D21/238 |
| D. 331,613 | 12/1992 | White | D21/238 |
| D. 333,903 | 3/1993 | Meredith | D2/40 |
| 2,563,122 | 8/1951 | Levine | 9/17.5 |
| 2,893,020 | 7/1959 | Miller | 9/20 |
| 3,181,183 | 5/1965 | Allen | 9/333 |
| 3,903,555 | 9/1975 | Busby | 9/342 |
| 3,956,786 | 5/1976 | O'Link | 9/345 |
| 4,052,762 | 10/1977 | Zawislak | 9/337 |
| 4,167,051 | 9/1979 | Galecke | 441/117 |
| 4,472,151 | 9/1984 | Hoffman | 441/127 |
| 4,496,328 | 1/1985 | Asher et al. | 441/55 |
| 4,692,125 | 9/1987 | Wessman | 441/112 |
| 4,871,338 | 10/1989 | Hoffman | 441/116 |
| 5,030,153 | 7/1991 | Bailey | 441/115 |
| 5,184,968 | 2/1993 | Michalochick et al. | 441/116 |
| 5,349,722 | 9/1994 | Chayer | 15/353 |
| 5,403,123 | 4/1995 | Walters | 405/286 |

*Primary Examiner*—Sherman Basinger
*Attorney, Agent, or Firm*—Pennie & Edmonds

[57] ABSTRACT

A personal flotation device is disclosed that maintains the user's face and head above the water level line, the flotation device having an anterior chest portion and an opposite posterior portion. At the top of the flotation device is a first shoulder portion and an opposite second shoulder portion. An anterior collar portion is hinged with a posterior collar portion. The portions are held into position by a two-way stretchable material.

16 Claims, 9 Drawing Sheets

COMBINATION FLOTATION DEVICE AND SWIMMING AID

TECHNICAL FIELD OF THE INVENTION

The present invention relates to flotation devices, and more particularly, to a flotation device for children that also may be used as an aid for swimming and swimming instructions.

BACKGROUND OF THE INVENTION

Many drownings occur every year, with a large percentage of these drownings involving children that are in accidental drownings. Making the situation worse, the number of households with backyard swimming pools has increased as the cost of the pools has decreased. Therefore, is a continued need for improved flotation devices, particularly flotation devices specifically designed for children.

The children flotation devices of the past are mostly of the type that include an inflatable ring portion with an attached animal shape or character shape; however, these devices are easily separated from the child. In addition, if a child is in the proximity of a pool, the child may accidently fall into the pool without having the flotation device nearby.

Most of the adult flotation devices include back and front panels, with some of the flotation devices having a collar portion that provides lift to the user's head with the objective of maintaining the head above the water level line.

For example, U.S. Pat. No. 2,563,122 issued to Levine discloses a flotation device in the configuration of a vest with internal air inflatable compartments. The fixedly attached buoyant elements cooperate to give a reclining angle to the body of the wearer to keep the nose and eyes out of the water.

U.S. Pat. No. 2,893,020 issued to Miller discloses a flotation device that has a collar portion with chest and back portions, the flotation device provides lift to the user's head while the user is lying in a supine position only in a body of water.

U.S. Pat. No 3,181,183 issued to Allen discloses a flotation device with front and back portions attached to collar portions. The collar portions are designed to give lift to the user's head while only in the supine and ventral positions in a body of water. The means for fastening the device to the body of wearer is inadequate since the device would tend to shift while being worn.

The embodiment shown in FIG. 6 discloses a crotch strap that is to be positioned around the pelvis area, which would be uncomfortable and not desirable for male users.

U.S. Pat. No. 3,903,555 issued to Bushy discloses a flotation device with collar portions attached to a front portion, which is attached to a crotch portion and finally a back portion. The back portion wraps around the wearer's pelvis area and fastens to straps at the shoulders. Since flotation devices shift in relation to the body of the wearer while worn, it is not desirable to wrap and secure the device around the pelvis area, particularly for male users, and more particularly for young male users whose body and genitals are still developing.

U.S. Pat. No. 3,956,786 issued to O'Link discloses a flotation device with collar portions attached to front and back portions. The front and back portions have openings for the user's arms to extend from the flotation device.

U.S. Pat. No. 4,052,762 discloses a flotation device for infants, the device having front and rear portions strapped around the waist and the shoulders of the infant; however, no flotation support is provided for the child's head.

U.S. Pat. No. 4,472,151 issued to Hoffman discloses a flotation device with front, rear, lateral, and headrest portions, which, when not in use, the portions fold into a block configuration for carrying.

U.S. Pat. No. 4,496,328 issued to Asher et al. discloses a combination swimming aid and flotation device in the configuration of a plurality of harnesses that encircle the user's torso area; however, not flotation support is provided for the wearer's head.

U.S. Pat. No. 4,692,125 issued to Wessman discloses a flotation device with a circular chest portion with attached arm portions. Flotation for the wearer's head is not provided for.

U.S. Pat. No. 4,871,338 issued to Hoffman discloses a flotation device with front and rear panels connected to shoulder panels. The rear shoulder panel provides support to the user's head while only lying in the supine position in the water.

U.S. Pat. No. 5,030,153 issued to Bailey discloses a flotation device with a front panel and a pair of back panels that are joined at the front to define an open back vest with a top opening. Flotation support is only given while the wearer is in the supine position in the water.

U.S. Pat. No. 5,184,968 issued to Michalochick et al. discloses a flotation device that is integrated with a swimsuit, the flotation members being located at the chest, upper back and shoulder area; however, no flotation support is provided for the head of the wearer.

The major disadvantage with the above listed flotation devices is that the user's face and head are not positively maintained above the water level line in every up-right and vertical position. For example, most of the flotation devices maintain the user's head above the water line when the user is only lying in the supine position.

Other devices are only useful if the user is lying either in the supine position or in the directly opposite ventral position.

What is needed is a flotation device that is specifically designed for children, where the device maintains the child's head above the water level line and wherein the device may also be used as an aid for swimming and swimming instructions.

DISCLOSURE OF THE INVENTION

It is, therefore, an object of the present invention to provide a flotation device that is specifically designed for children, wherein the flotation device essentially maintains the user's face and head above the water level line.

It is also an object of the present invention to provide a flotation device that may be used as an aid for swimming and swimming instructions while essentially maintaining the user's face and head above the water level line.

It is also an object of the present invention to provide a flotation device that provides freedom of movement of the users limbs, and specifically, the freedom of movement of the users arms.

It is also an object of the present invention to provide a flotation device that is integrated with a swimsuit and wherein the flotation device essentially does not shift in relation to the wearer's body while being worn.

It is also an object of the present invention to provide a flotation device that essentially maintains the user's face and head above the water level line and wherein the flotation device is comfortable to wear.

According to the present invention, a flotation device is disclosed that essentially maintains the user's face and head above the water level line, the flotation device having an anterior chest portion and an opposite posterior portion. At the top of the flotation device is a first shoulder portion and an opposite second shoulder portion. An anterior collar portion is hinged with a posterior collar portion. The portions are held into position by a two-way stretchable material.

The anterior and posterior portions provide flotation and support to the wearer's body while in a body of water, while the collar portions combine with the shoulder portions to essentially maintain the face and the head of the wearer above the water level line, whether the wearer is in a supine, a ventral, or either lateral position.

The collar portions are hinged to allow freedom of movement of the head and neck of the wearer, while the shoulder portions are configured to allow freedom of movement of the wearer's arms. Therefore, the flotation device of present invention promotes the teaching and the learning of the proper swimming strokes while having the benefit of the flotation device.

In a first embodiment, the flotation device is integrated into a swimsuit. In a second embodiment, the flotation device is strapped onto the user by a plurality of straps that wrap around the user's legs.

The foregoing and other advantages of the present invention will become more apparent from the following description and accompanying drawings.

BEST MODE FOR CARRYING OUT THE INVENTION

Figure 1:
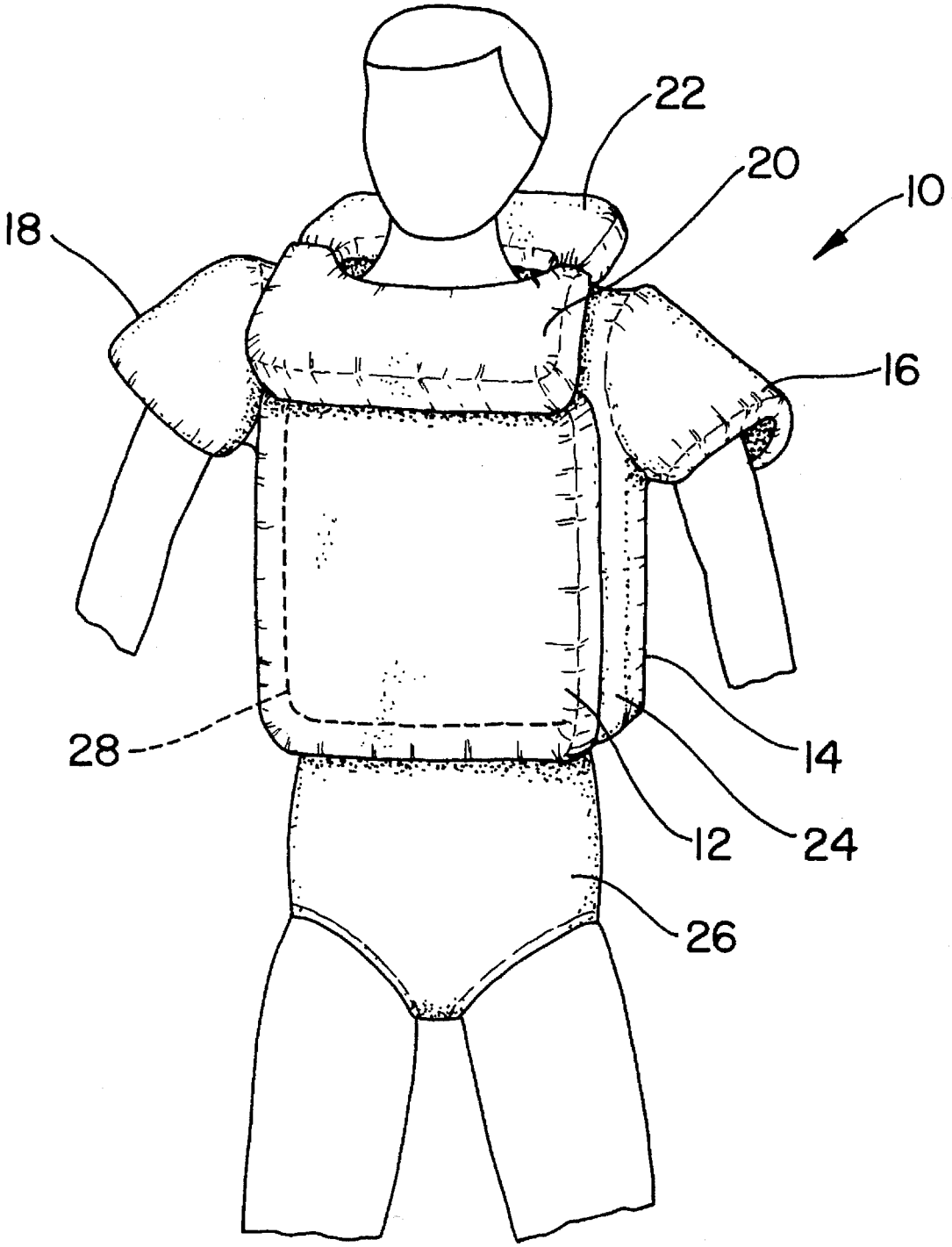
FIG. 1 is a front perspective view of a flotation device of the present invention.

According to the present invention, and as shown in FIG. 1, a flotation device 10 for children is disclosed. The flotation device 10 has a plurality of flotation members to provide lift and buoyancy to the user in a body of water and to essentially maintain the user's face and head above the water level line.

The flotation device 10 has an anterior panel portion 12 and an opposing posterior panel portion 14. The panel portions are generally flat and parallel to each other in the preferred embodiment; however, the panels may be formed to be arcuate in shape to fit the contour of the wearer's torso.

Positioned between the anterior and posterior panel portions 12 and 14 is a first shoulder portion 16 and an opposing second shoulder portion 18. The alignment of the shoulder portions 16 and 18 is parallel with the panel portions 12 and 14. The shoulder portions 16 and 18 are arcuate in shape and are positioned at the top of and extend laterally and tangentially from the top of the panel portions 12 and 14.

Extending forward and tangentially from the top of the anterior panel portion 12 is an anterior collar portion 20. An opposite posterior collar portion 22 extends rearward and tangentially from the top of the posterior panel portion 14.

The portions are held into their respective positions by a two-way stretch material 24, such as LYCRA. Successful prototypes of the flotation device of the present invention have been made with a two-way stretch material consisting of LYCRA with 20% SPANDEX.

The use of a two-way stretch material results in the stretch material pulling the flotation portions tightly against the body of the wearer, while allowing the wearer to have freedom of movement. Therefore, the wearer may perform a variety of swimming strokes without being hindered or restricted by the material of the flotation device 10.

The flotation device shown in FIG. 1 is in the configuration of a one-piece swimsuit, therefore, a bottom section 26 extends from the anterior and posterior panel portions 12 and 14. The flotation device shown and described in FIG. 1 my be worn as a one-piece swimsuit with no other swimming attire required.

Figure 2:
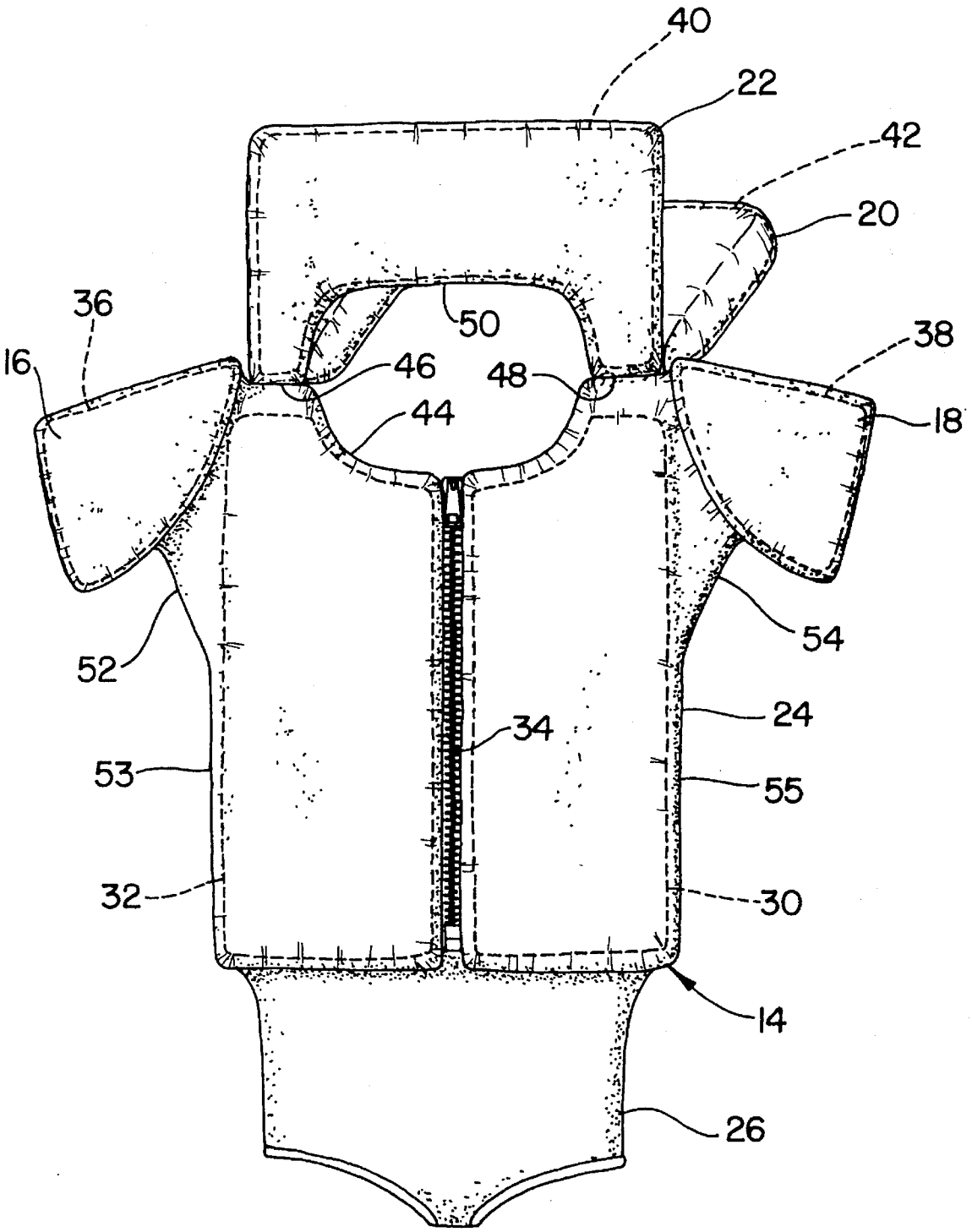
FIG. 2 is a back view of the flotation device of the present invention.

The anterior panel portion 12 has an anterior flotation panel 28 covered by the two-way stretch material 24. As shown in FIG. 2, the posterior flotation panel 14 has a first posterior flotation panel 30 and an opposing second posterior flotation panel 32. The posterior flotation panels 30 and 32 are held into position by the two-way stretch material 24. A posterior panel zipper 34 is sewn to the two-way stretch material 24 between the first and second posterior flotation panels 30 and 32.

Shown at the top of the posterior panel portion 14 is the first shoulder portion 16 and the second shoulder portion 18. The first shoulder portion 16 has a first shoulder flotation member 36 and the second shoulder portion 18 has a second flotation member 38.

Also at the top of the posterior panel portion 14, the posterior collar portion 22 is shown having an internal posterior collar flotation member 40. The opposite anterior collar portion 20 has an internal anterior collar flotation member 42.

Centrally located at the top of the flotation device 10 is an arcuate collar 44. Adjacent to the collar 44 is a first shoulder surface 46 and a second shoulder surface 48. The anterior collar portion 20 and the posterior collar portion 22 are sewn together in a hinged relationship at the first and second shoulder surfaces 46 and 48.

The two-way stretch material 24 has a first underarm portion 52 located directly under the first shoulder portion 16. A second underarm portion 54 is located directly under the second shoulder portion 18. The underarm portions 52 and 54 are outward extensions of the two-way stretch material 24 so that the user has added freedom of movement of the arms while the flotation device 10 is being worn.

Figure 3:
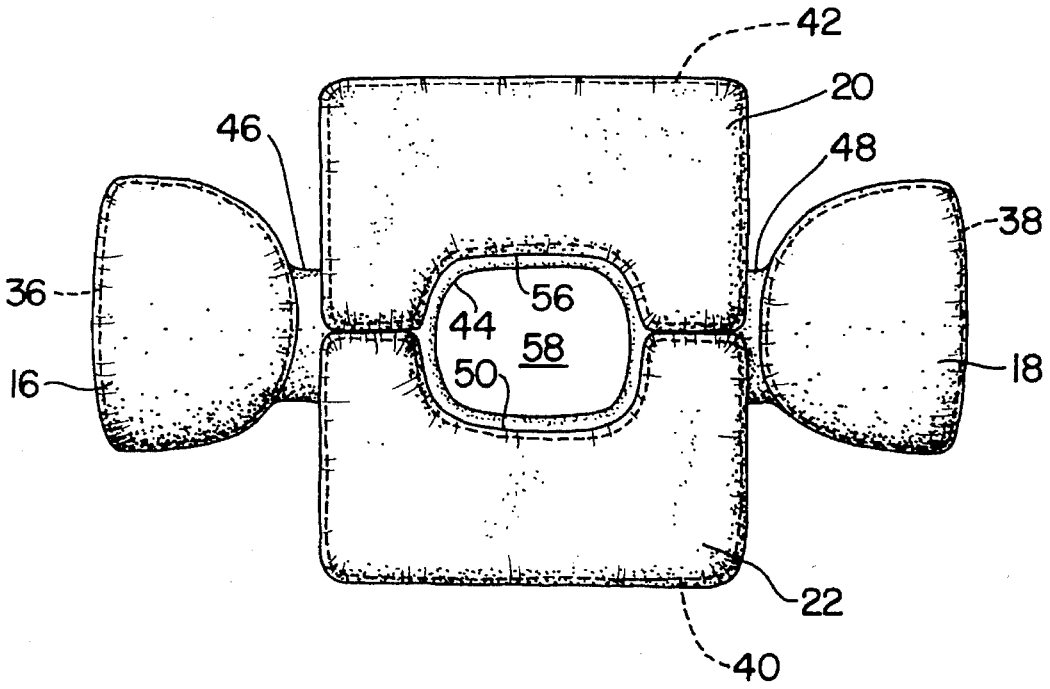
FIG. 3 is a top view of the flotation device of the present invention.

As shown in FIG. 3, the anterior collar portion 20 has an anterior panel collar 56 that is arcuate in shape; the posterior collar portion 22 has a posterior panel collar 50 that is also arcuate in shape. Together, the arcuate panel collars 56 and 50 follow the contour of the collar 44, defining a collar opening 58 for the passage of the wearer's head and neck.

The first shoulder portion 16 and the second shoulder portion 18 are each spaced external of the anterior and posterior collar portions 20 and 22 approximately the thickness of the respective shoulder portion so as to allow freedom of movement of the shoulder portions 16 and 18. The shoulder portions 16 and 18 pivot with the first shoulder surface 46 and the second shoulder surface 48 respectively, with the first underarm portion 52 and the second underarm portion 54 connecting the shoulder portions 16 and 18 with lateral sides 53 and 55 of the flotation device.

Therefore, swimming strokes, such as the freestyle stroke for example, may be taught to and executed by the wearer, while being unhindered by the flotation device 10.

Figure 4:
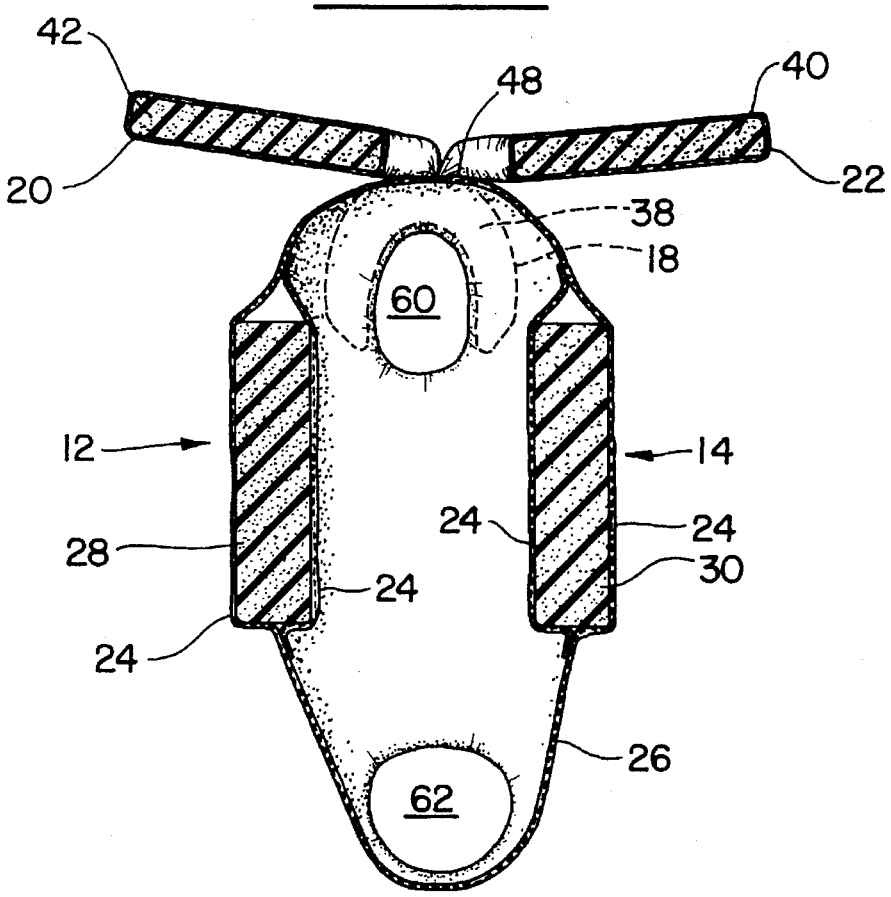
FIG. 4 is a cross sectional side view of the flotation device of the present invention.

As shown in FIG. 4, the anterior and posterior flotation panels 28 and 30 are sewn and held into place by the two-way stretch material 24, which is configured as a one-piece swimsuit. The flotation device 10 has a pair of arm openings, one arm opening being shown as 60, and a pair of leg openings, with one leg opening being shown as 62.

Figure 5:
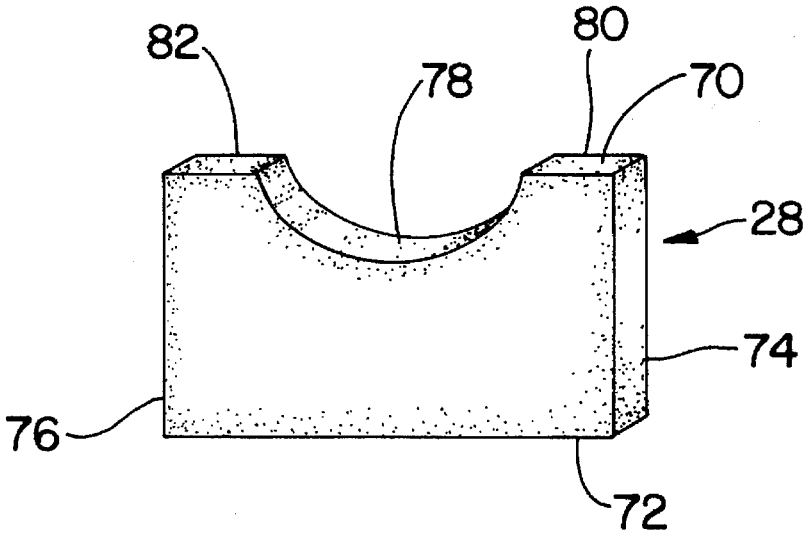
FIG. 5 is a front perspective view of an anterior flotation member of the present invention.

As shown in FIG. 5, the anterior flotation panel 28 has a top surface 70 and a bottom surface 72, which is generally parallel to the top surface. The anterior flotation panel 28 also has a first edge 74 and a second edge 76, the second edge 76 being generally parallel to the first edge 74. The edges 74 and 76 are generally perpendicular to the surfaces 70 and 72.

At the top surface 70 is a centrally located concave portion 78. The concave portion 78 defining a first ridge 80 at the first edge 74 and a second ridge 82 at the second edge 76. The first ridge 80 and the second ridge 82 extend to the first shoulder surface 46 and the second shoulder surface 48 respectively.

Figure 6:
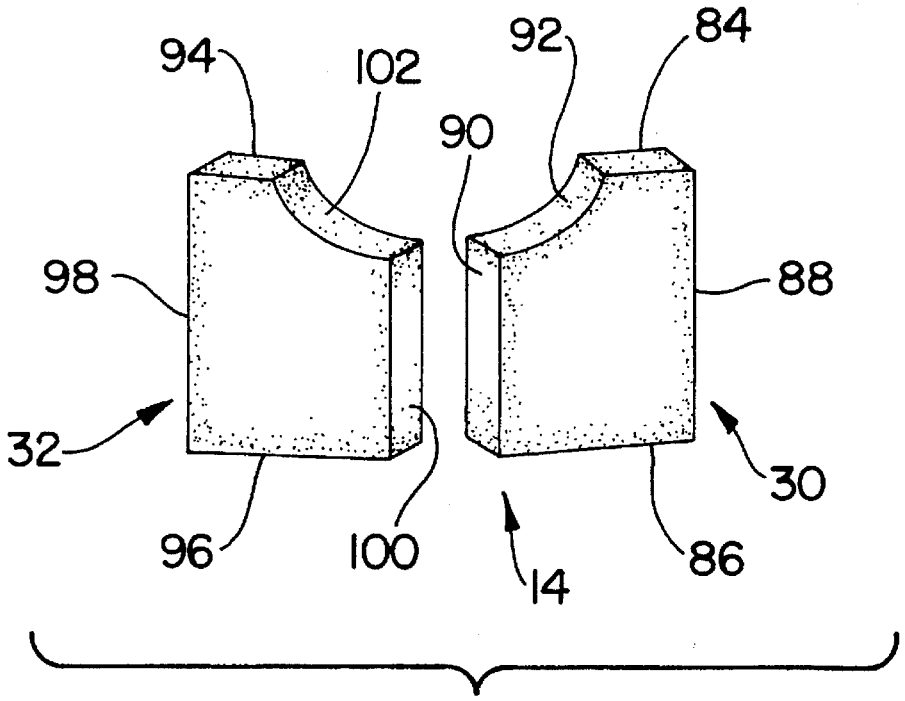
FIG. 6 is a front perspective view of a pair of posterior flotation members of the present invention.

As shown in FIG. 6, the posterior panel portion 14 comprises the first posterior flotation panel 30 and the second posterior flotation panel 32. The first flotation panel 30 has a top surface 84 and a bottom surface 86, which is generally parallel to the top surface 84. The first flotation panel 30 also has a first edge 88 and a second edge 90. The second edge 90 is generally parallel to the first edge 88. The edges 88 and 90 are generally perpendicular to the surfaces 84 and 86. A concave portion 92 extends from the top surface 84 to the second edge 90.

The second flotation panel 32 has a top surface 94 and a bottom surface 96, which is generally parallel to the top surface 94. The second flotation panel 32 also has a first edge 98 and a second edge 100. The second edge 100 is generally parallel to the first edge 98. The edges 98 and 100 are generally perpendicular to the surfaces 94 and 96. A concave portion 102 extends from the top surface 94 to the second edge 100.

Figure 7:
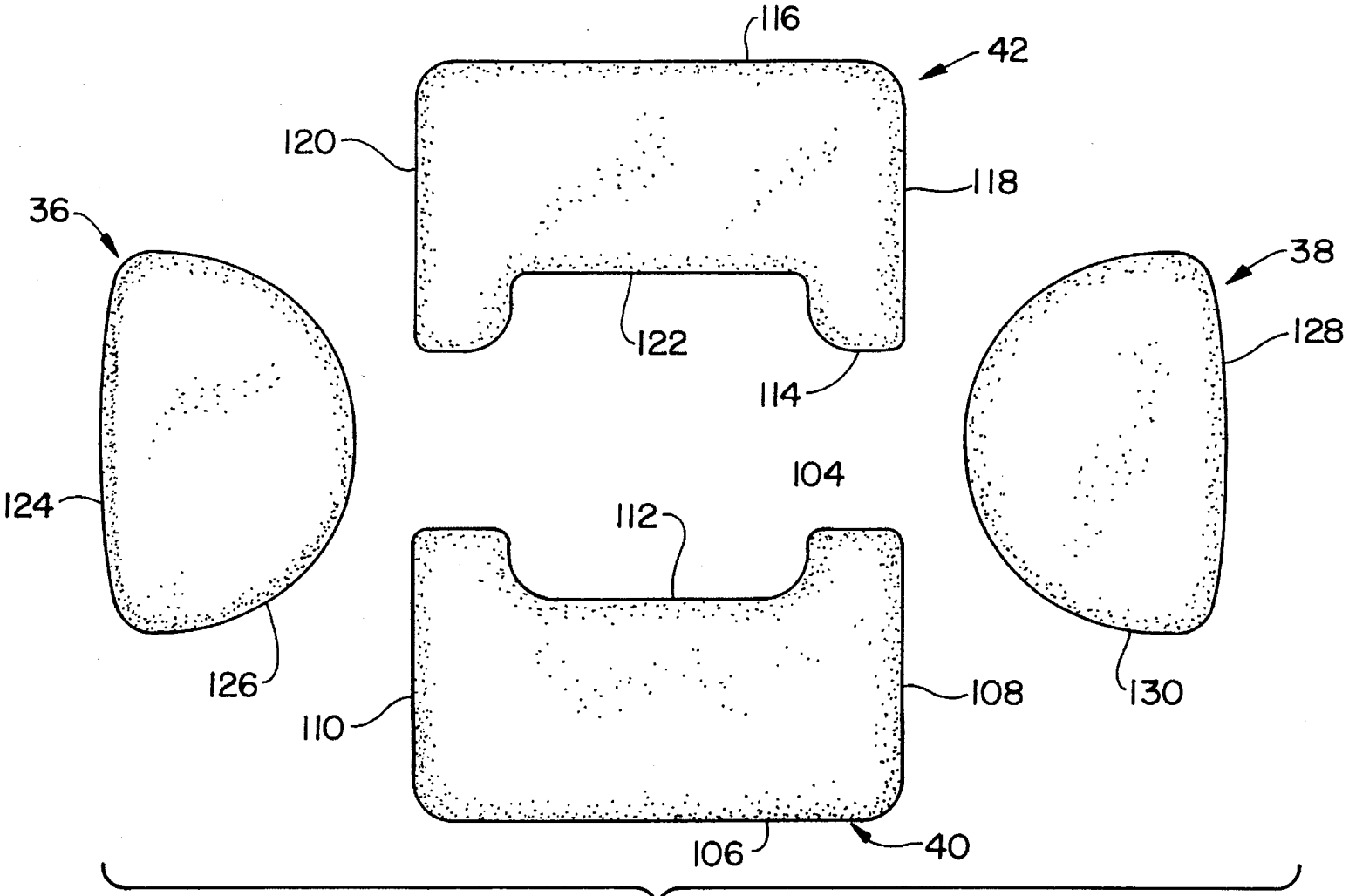
FIG. 7 is a top plan view of an anterior collar flotation member, a posterior collar flotation member, a first shoulder flotation member, and a second shoulder flotation member.

As shown in FIG. 7, the posterior collar flotation member 40 has a first surface 104 and a second surface 106, the second surface 106 being generally parallel to the first surface 104. The collar flotation member 40 also has a first edge 108 and a second edge 110, the edges 108 and 110 being generally parallel with each other and being generally perpendicular to the surfaces 104 and 106. The first surface 104 has a cut-out portion 112 to follow the contour of the collar 44 and the collar opening 58.

The anterior collar flotation member 42 has a first surface 114 and a second surface 116, the second surface 116 being generally parallel to the first surface 114. The collar flotation member 42 also has a first edge 118 and a second edge 120, the edges 118 and 120 being generally parallel with each other and being generally perpendicular to the surfaces 114 and 116. The first surface 114 has a cut-out portion 122 to essentially follow the contour of the collar 44 and the collar opening 58; however, the cut-out portion 122 is cut to be adjacent to the neck so that flotation support is given to the underside of the chin of the wearer.

The first shoulder flotation member 36 is semi-circular in shape in plan view, with a semi-circular portion 126 and an outer edge 124. Likewise, the second shoulder flotation member 38 is semi-circular in shape in plan view, with a semi-circular portion 130 and an outer edge 128.

The shoulder portions 36 and 38 are arcuate in shape when they are housed in the two-way stretch material 24. The shoulder portions 36 and 38 extend around the outer surface of the wearer's arms when worn, but do not extend across the inner surface of the arms. This arrangement allows the wearer to have unrestricted freedom of movement of the arms when the arms are placed at the sides of the wearer's torso.

Figure 8:
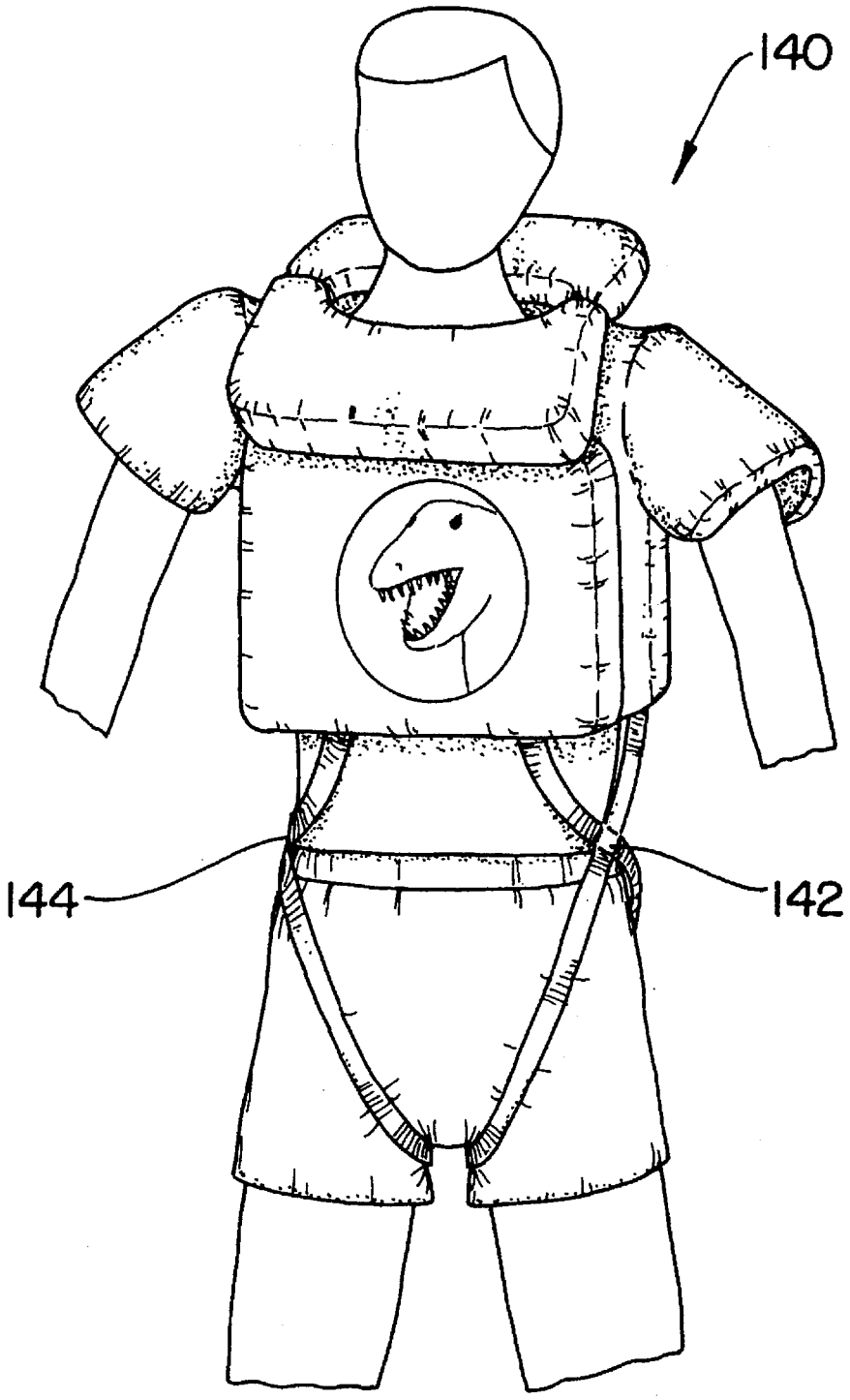
FIG. 8 is a front perspective view of a separate embodiment of a flotation device of the present invention.

Since some children may desire to wear their own swimsuit instead of wearing the flotation device described above, a flotation device 140 is described as a separate embodiment, which is shown in FIG. 8.

The flotation device 140 is similar to the above described flotation device, except that the flotation device has a plurality of straps to fasten the flotation device to the wearer. The flotation device has a first strap assembly 142 that extends from the flotation device. The first strap assembly 142 wraps and fastens around the wearer's first leg. A complimentary second strap assembly 144 extends from the flotation device; the second strap assembly 144 wraps and fastens around the wearer's second leg. The straps wrap around the inner surface of the wearer's thighs, and therefore, do not place pressure on the wearer's pelvis region.

Figure 9:
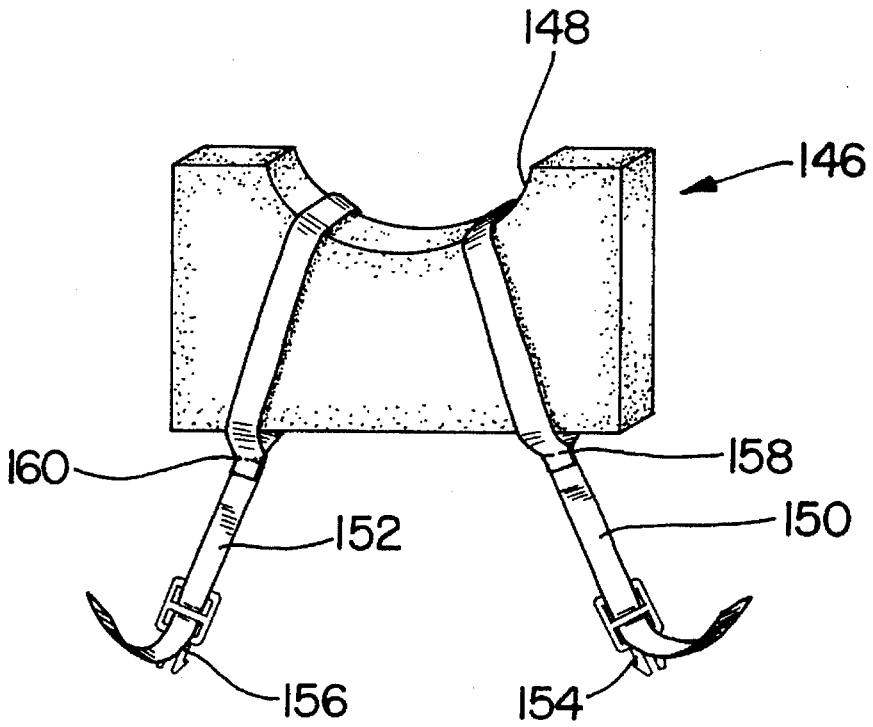
FIG. 9 is a front perspective view of an anterior flotation member of a separate embodiment of the present invention.

As shown in FIG. 9, a first anterior flotation panel 146 has a centrally located concave portion 148 with a first anterior elastic strap 150 securely fastened around the panel 146 and the concave portion 148. At the distal end of the first anterior strap 150 is a length adjustable male fastener 154.

A second anterior elastic strap 152 is securely fastened around the panel 146 and the concave portion 148. At the distal end of the second anterior strap 152 is a length adjustable male fastener 156.

The first anterior strap 150 is sewn together at the bottom surface of the anterior flotation panel 146 at a first anterior strap attachment point 158. Likewise, the second anterior strap 152 is sewn together at the bottom surface of the anterior flotation panel 146 at a second anterior strap attachment point 160. The elastic straps 150 and 152 are wrapped tightly around the anterior flotation panel 146 and then sewn at attachment points 158 and 160.

Figure 10:
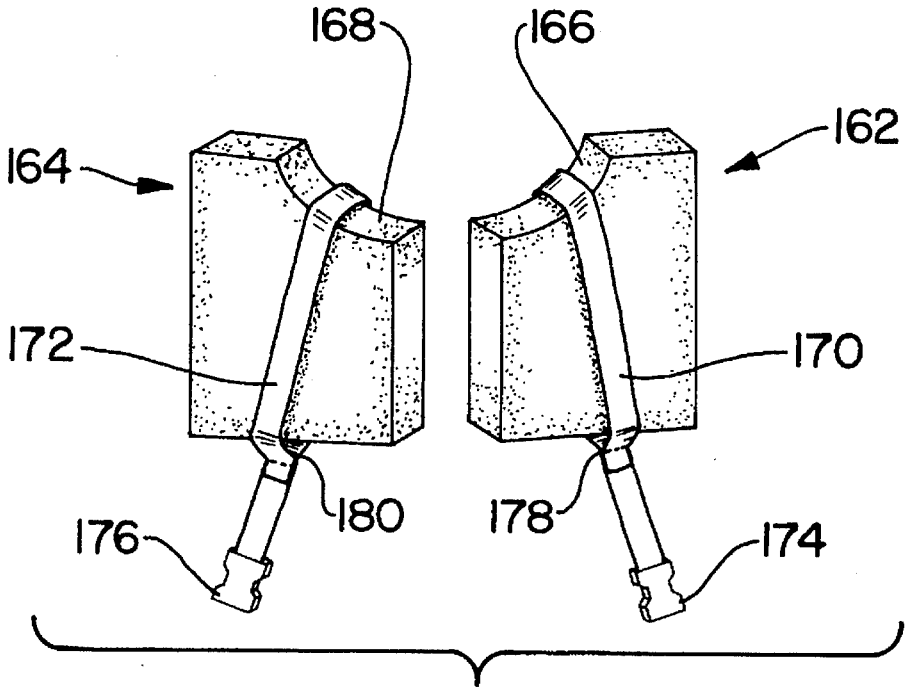
FIG. 10 is a front perspective view of a pair of posterior flotation members of a separate embodiment of the present invention.

As shown in FIG. 10, a first posterior flotation panel 162 has a concave portion 166. A first posterior elastic strap 170 is tightly wrapped around the first posterior flotation panel 162 and the concave portion 166, then sewn together at a first posterior strap attachment point 178. At the distal end of the first posterior strap 170 is a female fastener 174.

A second posterior flotation panel 164 has a concave portion 168. A second posterior elastic strap 172 is tightly wrapped around the second posterior flotation panel 164 and the concave portion 168, then sewn together at a second posterior strap attachment point 180. At the distal end of the second posterior strap 172 is a female fastener 176.

Figure 11:
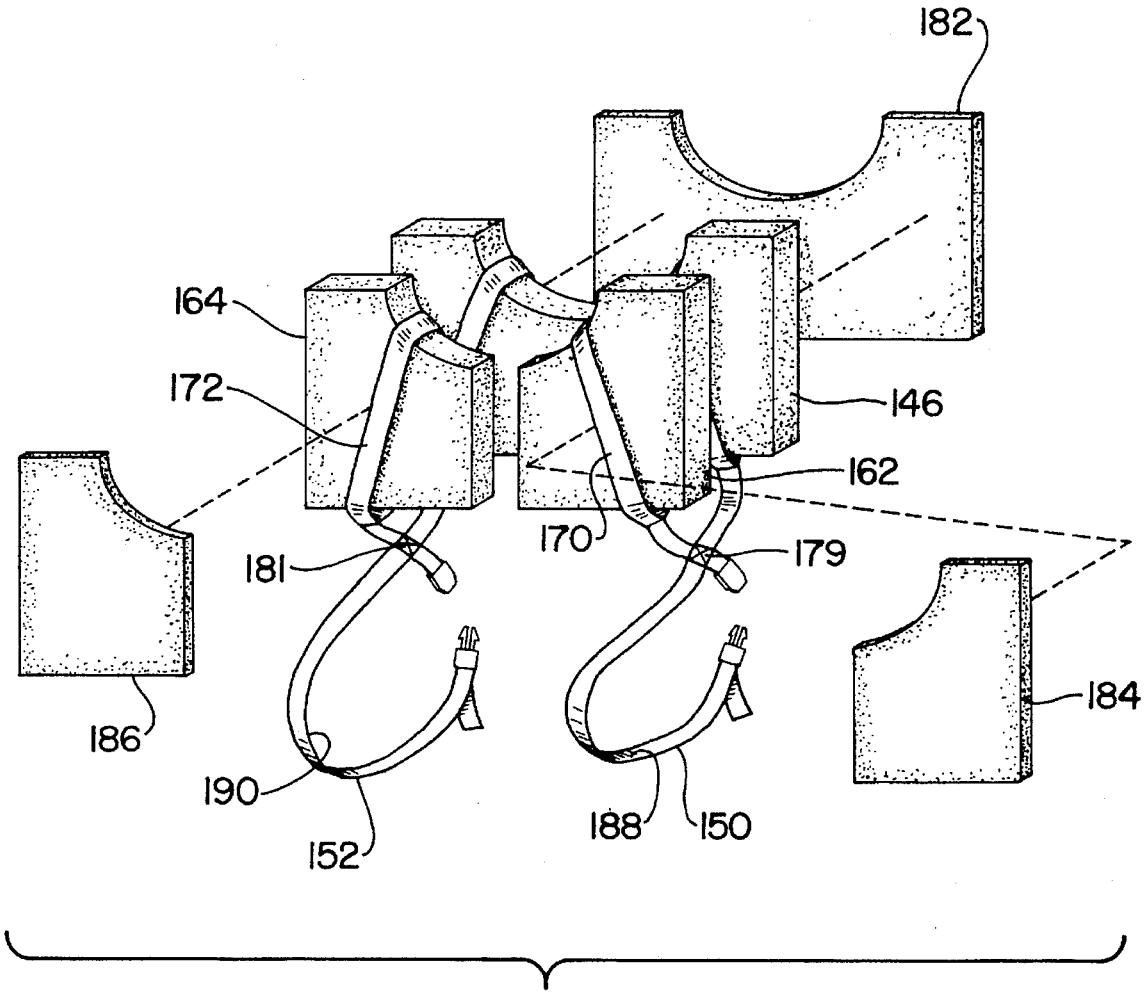
FIG. 11 is a rear perspective exploded view of the assembly of the anterior and posterior flotation members.

As shown in FIG. 11, an assembly of flotation panels and straps combine to comprise the flotation and fastening means of the second embodiment. The anterior and posterior collar portions, the first and second shoulder portions, and the two-way stretch material are not shown in FIG. 11; however, all of the portions are needed to comprise the flotation device 140 in the second embodiment. FIG. 11 is intended to show and explain how the flotation panels and the strap assemblies cooperate together.

The first anterior flotation panel 146 is shown directly in front of the first posterior flotation panel 162 and the second posterior flotation panel 164. The first anterior strap 150 is sewn to the first posterior strap 170 at a first strap attachment point 179. The second anterior strap 152 is sewn to the second posterior strap 172 at a second strap attachment point 181. The first anterior strap 150 is wrapped around the first inner thigh of the wearer defining a first thigh loop 188, then the fasteners 156 and 176 are fastened together.

The second anterior strap 152 is wrapped around the second inner thigh of the wearer defining a second leg loop 190, then the fasteners 154 and 174 are fastened together. The fasteners are exposed to the outside surface of the wearer's thighs after being fastened so that adjustments may be made at the male fasteners 154 and 156, if required.

The fasteners are of the type that each have two male prongs that snap into position at a female receptacle. When the fastener is to be released, the two prongs are depressed and the male fastener is pulled out of the female receptacle. Nevertheless, other fasteners may be utilized to accomplish the same objectives as the fasteners shown and described.

A second anterior flotation panel 182 has the same exterior shape as the first anterior flotation panel 146. In addition, a third posterior flotation panel 184 has the same exterior shape as the first posterior flotation panel 162, and a fourth posterior flotation panel 186 has the same exterior shape as the second posterior flotation panel 164. The panels 182, 184, and 186 are positioned at the exterior surfaces of panels 146, 162, and 164, so that when the panels are assembled in the two-way stretch material, the strap assemblies 150, 152, 170, and 172 do not show through the two-way stretch material, giving the flotation device 140 a smooth and neat appearance.

Figure 12:
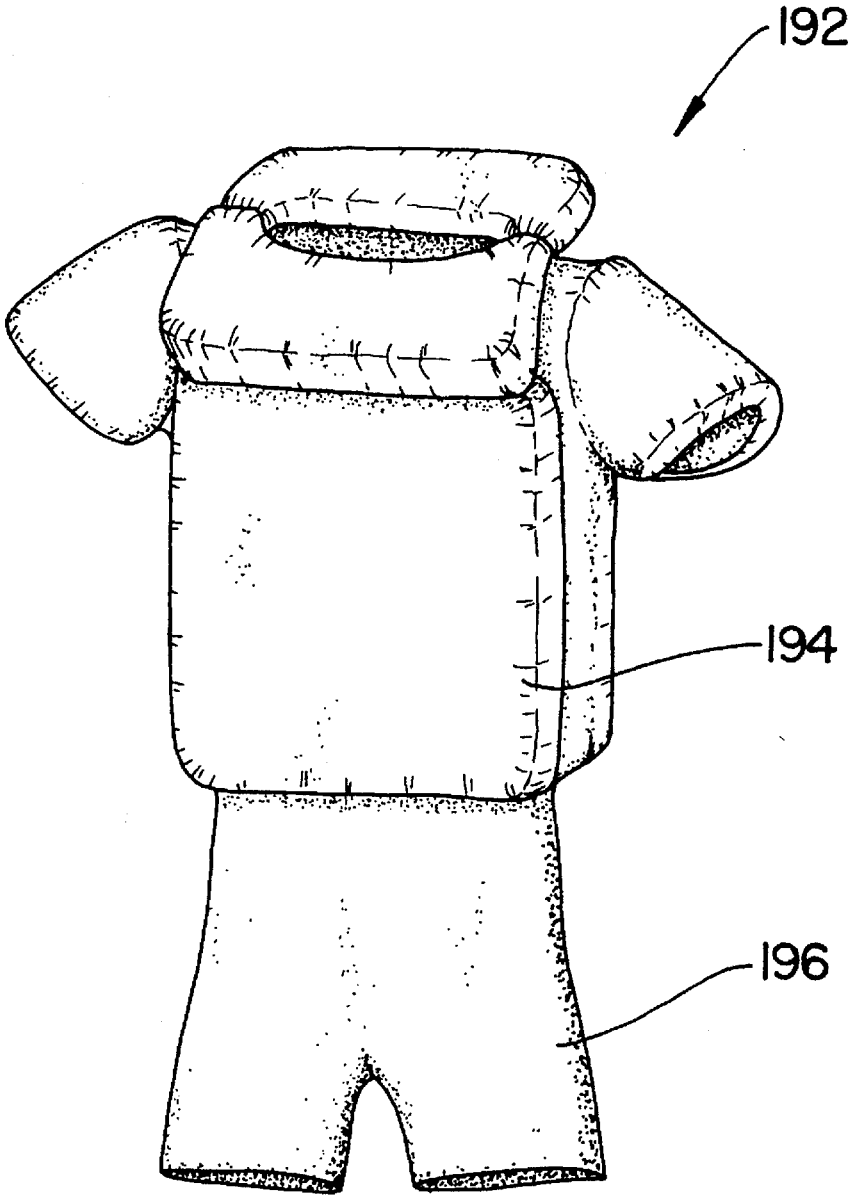
FIG. 12 is front perspective view of a separate embodiment of a flotation device of the present invention.

Yet a separate embodiment is shown in FIG. 12, showing a flotation device 192 similar to the flotation device shown and described in FIG. 1, except that the bottom portion 196 has a configuration that resembles shorts instead of a swimsuit configuration. The flotation device 192 has a flotation portion 194 similar to the above flotation devices and the attached bottom section 196.

The above described flotation devices have been successfully implemented and tested by a test group of children ranging in age from one years old to five years old and ranging in weight from 34 pounds to 40 pounds. All of the tests on the children provided successful results in maintaining their faces above the water level line, whether the child was lying in the supine, ventral, or either lateral position.

The successful prototypes utilized a U.S. Coast Guard approved FLO-10 flotation material that may be purchased from RUBATEX; however, the anterior collar flotation member may utilize a material that is more rigid than FLO-10, such a ENSOLITE, which may be purchased from UNIROYAL. The anterior collar flotation member may be made from a fairly rigid material because some children have a tendency to grab the edges of the anterior collar portion.

One of the requirements for a personal flotation device to be approved by the U.S. Coast Guard is that flotation devices for children weighing less than 50 pounds must have seven pounds or more of buoyancy force from the device. See 46 C.F.R. § 160,064-4(d).

A current U.S. Coast Guard approved children flotation device was disassembled and analyzed. The baseline device had a 7.5 force pounds (lbf), or buoyancy force, rating with 222 cubic inches of flotation material. The prototype of the flotation device of the present invention has a 11.7 lbf with 381 cubic inches of flotation material. Expanding the calculations further yields: the baseline device was rated for a 50 pound child with 31 Newtons of upward force, while the flotation device of the present invention provides 53 Newtons of upward force for a 69 pound child.

From the calculations it is seen that the flotation device of the present invention provides 11.7 force pounds of lift, or buoyancy force, for a child weighing up to 69 pounds, which exceeds the U.S. Coast Guard required 7 pounds of buoyancy for a child weighing 50 pounds.

In addition, the flotation device of the present invention provides buoyancy for children weighing approximately 69 pounds, which typically would be adequate for children up to approximately five years old.

The flotation device of the present invention is intended for children ranging in ages from approximately six months old to five years old with weights ranging from approximately 20 pounds to 50 pounds. The flotation device of the present invention has a plurality of flotation members that maintain the wearer's face out of the water and above the water level line. The anterior collar portion, the posterior collar portion, and the first and second shoulder portions combine to provide essentially complete support to the wearer's face in relation to the water level line.

The anterior collar portion and the posterior collar portion are hinged at the first and second shoulder surfaces. Therefore, as the wearer is in a body of water in the ventral position, the anterior collar portion pivots and maintains the wearer's face above the water level line.

Likewise, when the wearer is in a body of water in the supine position, the posterior collar portion pivots and maintains the wearer's face above the water level line. In addition, the first and second shoulder flotation members provide lateral flotation support as the wearer leans to the left or the right in the water.

The flotation device of the present invention provides the wearer complete freedom of range of motion of the wearer's arms and legs, allowing the wearer to learn the proper swimming strokes while being supported in the water by the flotation device. In addition, the flotation device of the present invention, with the padded shoulders, has a configuration and shape that resembles a super hero look, therefore, the child will find the flotation device to be fun to wear.

Although this invention has been shown and described with respect to a detailed embodiment, those skilled in the art will understand that various changes in form and detail may be made without departing from the spirit and scope of the claimed invention.

I claim:

1. A personal flotation device for providing support and lift to the wearer's body, face and head while in a body of water, comprising:

an anterior flotation panel portion and an opposing posterior flotation panel portion, the flotation panel portions being generally parallel with each other;

a first shoulder flotation portion and an opposing second shoulder flotation portion, the shoulder flotation portions being at the top of and extending tangentially from the flotation panel portions;

an anterior collar flotation portion and an opposing posterior collar flotation portion, the anterior collar flotation portion extending forward and tangentially from the top of the anterior panel flotation portion, the posterior collar flotation portion extending rearward and tangentially from the top of the posterior flotation panel portion;

the collar flotation portions being hinged together so that the collars may pivot to provide support to the wearer's face and head in relation to the water level line.

2. The flotation device of claim 1, wherein the anterior and posterior flotation panel portions, the shoulder flotation portions, and the collar flotation portions are held into place by a two-way stretch material.

3. The flotation device of claim 2, wherein the two-way stretch material is LYCRA with 20% SPANDEX.

4. The flotation device of claim 2, wherein the flotation device is in the shape of a one-piece swimsuit.

5. The flotation device of claim 2, the posterior flotation panel portion further comprising:

a first posterior flotation panel and a second posterior flotation panel, a posterior panel zipper being sewn to the two-way stretch material between the first and the second posterior flotation panels.

6. The flotation device of claim 5, further comprising:

a first underarm portion extending from the first shoulder flotation portion to a flotation device first lateral side and a second underarm portion extending from the second shoulder flotation portion to a flotation device second lateral side.

7. The flotation device of claim 6, further comprising:

the first shoulder flotation portion and the second shoulder flotation portion each being spaced external of the anterior and the posterior collar flotation portions approximately the thickness of the respective shoulder portion.

8. The flotation device of claim 2, further comprising:

a first strap assembly and a second strap assembly, the strap assemblies extending from the flotation device;

the first strap assembly comprising a first anterior strap and a first posterior strap, the first anterior strap being fastened to the anterior flotation panel portion, the first posterior strap being fastened to the posterior flotation panel portion, the first anterior strap being sewn to the first posterior strap;

the second strap assembly comprising a second anterior strap and a second posterior strap, the second anterior strap being fastened to the anterior flotation panel portion, the second posterior strap being fastened to the posterior flotation panel portion, the second anterior strap being sewn to the second posterior strap;

the strap assemblies each having an adjustable fastening means.

9. The flotation device of claim 8, wherein the first and the second strap assemblies each wrap around an inner thigh of the wearer and each fasten at the outer thigh.

10. The flotation device of claim 8, the posterior flotation panel portion further comprising:

a first posterior flotation panel and a second posterior flotation panel, a posterior panel zipper being sewn to the two-way stretch material between the first and the second posterior flotation panels.

11. The flotation device of claim 10, further comprising:

a first anterior flotation panel and a second anterior flotation panel, the second anterior flotation panel being positioned external of the first anterior flotation panel;

a third posterior flotation panel and a fourth posterior flotation panel, the third posterior flotation panel and the fourth posterior flotation panel each being positioned at the external of the first posterior flotation panel and the second posterior flotation panel respectively, the panels being held into position by the two-way stretch material.

12. The flotation device of claim 11, the flotation device further comprising:

an anterior collar flotation panel and a posterior collar flotation panel, the panels being made from FLO-10 flotation material.

13. The flotation device of claim 11, the flotation device further comprising:

an anterior collar flotation panel being made from ENSOLITE flotation material and a posterior collar flotation panel being made from FLO-10 flotation material.

14. The flotation device of claim 1, wherein the shoulder flotation portions are arcuate in shape.

15. A personal flotation device for providing support and lift to the wearer's body, face and head while in a body of water, comprising:

an anterior flotation panel portion and an opposing posterior flotation panel portion, the flotation panel portions being generally parallel with each other;

a first shoulder flotation portion and an opposing second shoulder flotation portion, the shoulder flotation portions being at the top of and extending tangentially from the flotation panel portions;

an anterior collar flotation portion and an opposing posterior collar flotation portion, the anterior collar flotation portion extending forward and tangentially from the top of the anterior panel flotation portion, the posterior collar flotation portion extending rearward and tangentially from the top of the posterior flotation panel portion;

the collar flotation portions being hinged together so that the collars may pivot to provide support to the wearer's face and head in relation to the water level line; and adjustable fastening means to fasten the flotation device to the wearer.

16. The flotation device of claim 15, wherein the anterior and posterior flotation panel portions, the shoulder flotation portions, and the collar flotation portions are held into place by a two-way stretch material.

* * * * *